United States Patent [19]

Tai

[11] Patent Number: 4,868,941

[45] Date of Patent: Sep. 26, 1989

[54] ASSEMBLED MATTRESS HAVING BELLOWS FOR JACKETING SPRING THEREIN

[76] Inventor: Hsin-Fen Tai, P. O. Box 10160, Taipei, Taiwan

[21] Appl. No.: 262,702

[22] Filed: Oct. 26, 1988

[51] Int. Cl.[4] ..... A47C 27/04; A47C 31/02

[52] U.S. Cl. ..... 5/477; 5/475; 5/470; 5/465; 267/91

[58] Field of Search ..... 5/470, 471, 464, 475, 5/477, 465; 297/233; 267/91, 95

[56] References Cited

U.S. PATENT DOCUMENTS

| | | | |
|---|---|---|---|
| 1,153,644 | 9/1915 | Rilling | 5/465 |
| 1,271,672 | 7/1918 | Crowley et al. | 5/470 |
| 2,146,059 | 2/1939 | Drake | 5/470 |
| 2,247,667 | 7/1941 | Rosberger | 5/465 |
| 2,415,150 | 2/1947 | Stein | 5/464 |
| 2,425,728 | 8/1947 | Cobb | 5/470 |
| 3,145,020 | 8/1964 | Calla | 5/477 |
| 3,251,078 | 5/1966 | Calla | 5/477 |
| 3,623,171 | 11/1971 | Arkin | 5/477 |
| 3,950,800 | 4/1976 | Garshfield | 5/470 |

FOREIGN PATENT DOCUMENTS

| | | | |
|---|---|---|---|
| 2414316 | 9/1979 | France | 5/464 |

*Primary Examiner*—Alexander Grosz

[57] ABSTRACT

An assembled bed mattress includes an upper sheet having a plurality of upper sleeves made as bellows protruding downwardly from the upper sheet, a lower sheet having a plurality of lower sleeves made as bellows protruding upwardly from the lower sheet each lower sleeve being axially aligned with each upper sleeve, a plurality of helical springs each spring jacketed in each upper sleeve and each lower sleeve, and a fastener wire or zipper securing the two sheets to form an integral bed mattress having the plurality of springs resiliently retained between the two sheets, whereby upon a dismantling of the two sheets, any partial damaged springs can be replaced with perfect springs for easier maintenance of a mattress.

5 Claims, 2 Drawing Sheets

ASSEMBLED MATTRESS HAVING BELLOWS FOR JACKETING SPRING THEREIN

BACKGROUND OF THE INVENTION

A conventional bed mattress may have the following drawbacks in use:

1. After being used for a time period, some springs may lose their resilience due to elastic fatigue, which are difficult to be repaired as firmly secured inside the bed mattress. To discard the damaged mattress for instance, having only two or three springs damaged may be wasteful or may increase the problem of waste disposal of garbage.
2. The transporting or handling a big conventional nonseparable bed such as a double bed, may be obstructed by a narrow door or window especially of a small apartment.
3. During the making of a conventional bed mattress, each of the plural springs must be firmly secured inside the mattress by a conventional fixation method thereby increasing the production cost and maintenance difficulty.

The present inventor has found the drawbacks of a conventional bed mattress and invented the present assembled bed mattress with springs jacketed in sleeves.

SUMMARY OF THE INVENTION

The object of the present invention is to provide an assembled bed mattress including an upper sheet having a plurality of upper sleeves protruding downwardly under the upper sheet, a lower sheet having a plurality of lower sleeves protruding upwardly above the lower sheet each lower sleeve axially aligned with each upper sleeve, a plurality of helical springs each jacketed between the upper sleeve and the lower sleeve, and a fastening means combining the upper sheet with the lower sheet, so that the upper sheet may be disassembled from the lower sheet for optionally repairing any damaged spring and for convenient handling of a knock-down bed mattress.

DETAILED DESCRIPTION

Figure 1:
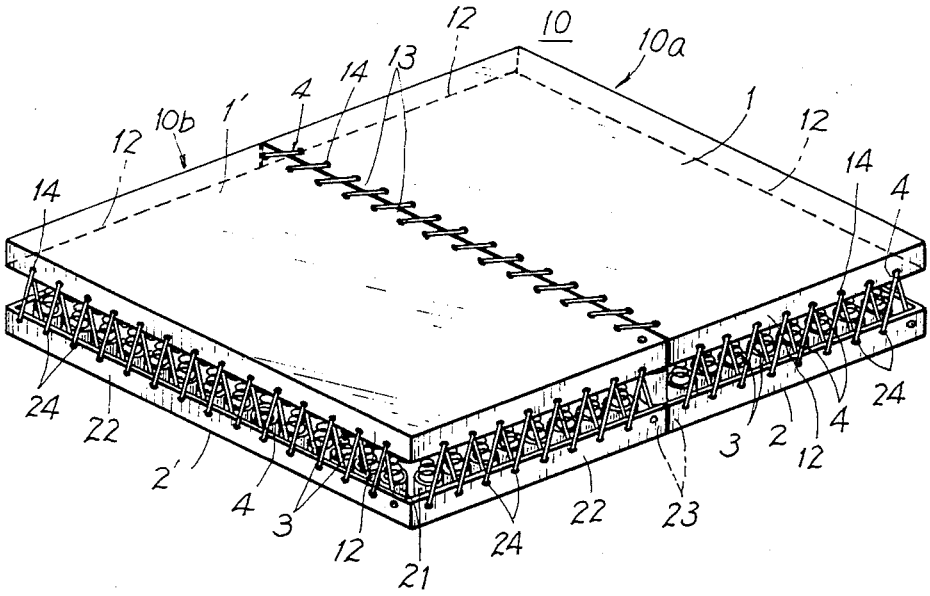
FIG. 1 is an illustration showing a mattress of the present invention.
Figure 2:
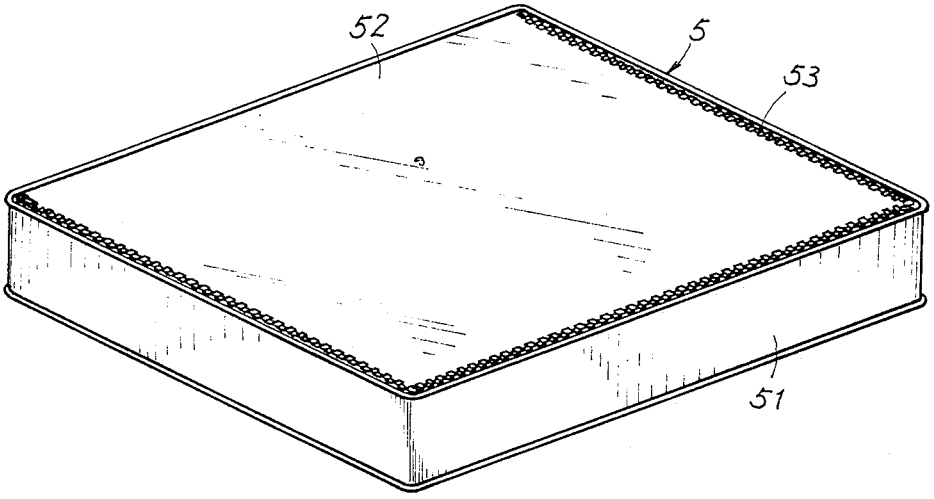
FIG. 2 is an illustration showing an outer jacket encasing the mattress of the present invention.
Figure 3:
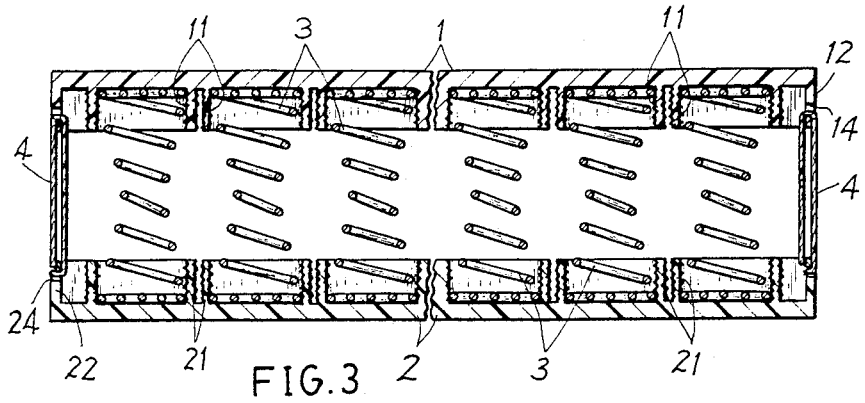
FIG. 3 is a sectional drawing of the mattress of the present invention.

As shown in FIGS. 1–4, the present invention comprises: a mattress 10 having a first mattress unit 10*a* combinable with a second mattress unit 10*b*, and an outer jacket 5 encasing the mattress 10.

The first mattress unit 10*a* includes: an upper sheet 1 having a plurality of upper sleeves 11 protruding downwardly from the upper sheet 1, a vertical side edge 12 formed on an outer periphery of the upper sheet 1, a horizontal side edge 13 formed on an inner periphery of the sheet 1 adjacent to the outer periphery of the vertical side edge 12, and a plurality of perforations or eyelets 14 formed in and evenly circumferentially disposed on all side edges 12, 13; a lower sheet 2 projectively positioned under the upper sheet 1 having a plurality of lower sleeves 21 protruding upwardly from the lower sheet 2 each sleeve 21 being axially aligned with each upper sleeve 11, a vertical side edge 22 formed on an outer periphery of the lower sheet 2, a horizontal side edge 23 formed on an inner periphery of the sheet 2 adjacent to the outer periphery of the vertical side edge 22, and a plurality of perforations or eyelets 24 formed in and evenly circumferentially disposed on the side edges 22, 23; a plurality of helical springs 3 of which each spring 3 has its upper portion jacketed in each upper sleeve 11 and has its lower portion jacketed in each lower sleeve 21 axially jacketed aligned with the upper sleeve 11 and each spring resiliently retained between the upper sheet 1 and the lower sheet 2; and a fastening means 4 which may be a thread, a rope, a wire or the like operatively combining the upper sheet 1 with the lower sheet 2 by passing the fastening means 4 through the upper perforations 14 and the lower perforations respectively formed in the side edges 12, 22.

The second mattress unit 10*b* includes: an upper sheet 1' having a structure same as that of the upper sheet 1, a lower sheet 2' having a structure same as that of the lower sheet 2, a plurality of helical springs 3 resiliently retained between a plurality of upper sleeves 11 formed in the upper sheet 1' and a plurality of lower sleeves 21 formed in the lower sheet 2', and a fastening means 4 securing the two sheets 1', 2' together as aforementioned.

The horizontal side edge 13 of the upper sheet 1 of the first mattress unit 10*a* is fastened to the other horizontal side edge 13 of the upper sheet 1' of the second mattress unit 10*b*, and the horizontal side edge 23 of the lower sheet 2 of the first mattress unit 10*a* is fastened to the other horizontal side edge 23 of the lower sheet 2' of the second mattress unit 10*b*, thereby combining the first mattress unit 10*a* with the second mattress unit 10*b* to form an integral the mattress 10 of the present invention.

Figure 4:
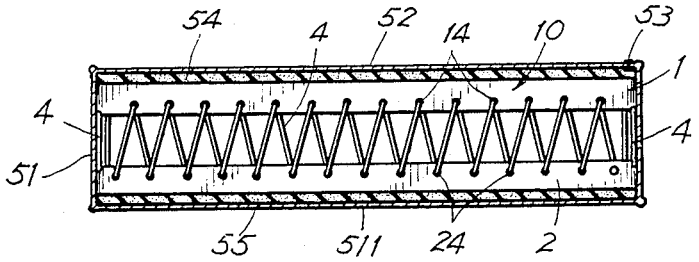
FIG. 4 is a sectional drawing of the complete set of the present invention.

The outer jacket 5 includes: a base casing 51 for storing the mattress 10 therein, an upper cover 52 secured to the casing 51 by a zipper 53, an upper liner packing 54 formed under the upper cover 51, and a lower liner packing 55 formed on a bottom plate 511 of the base casing 51. The upper liner packing 54 and lower liner packing 55 may be made of: sponge, foam, cotton, or any other cushioning materials. After storing the mattress 10 into the outer jacket 5 as shown in FIG. 4, the upper liner packing 54 is elastically retained between the upper cover 52 and the upper sheets 1, 1' of the mattress 10 and the lower liner packing 55 is elastically retained between the lower sheets 2, 2' of the mattress 10 and the bottom plate 511 of the casing 51 to form an integrated bed mattress having comfortable elasticity. The embodiment as shown in FIGS. 1–4 may serve as a double bed mattress.

Figure 5:
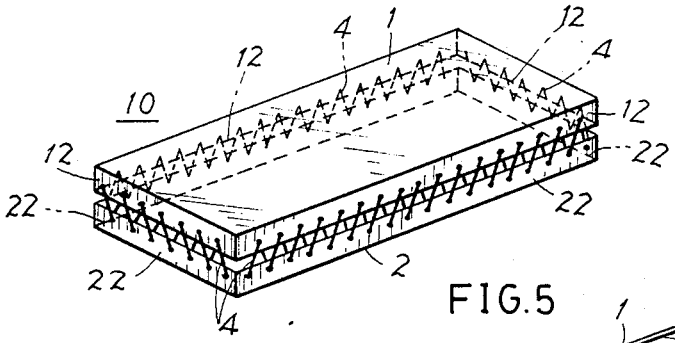
FIG. 5 is an illustration showing another preferred embodiment of the present invention.

As shown in FIG. 5, a single bed mattress is formed, which is quite similar to the structure of the mattress as aforesaid, except that all the side edges 12 are formed as vertical edges so that a fastening means 4 is provided to fasten the upper sheet 1 with the lower sheet 2.

Figure 6:
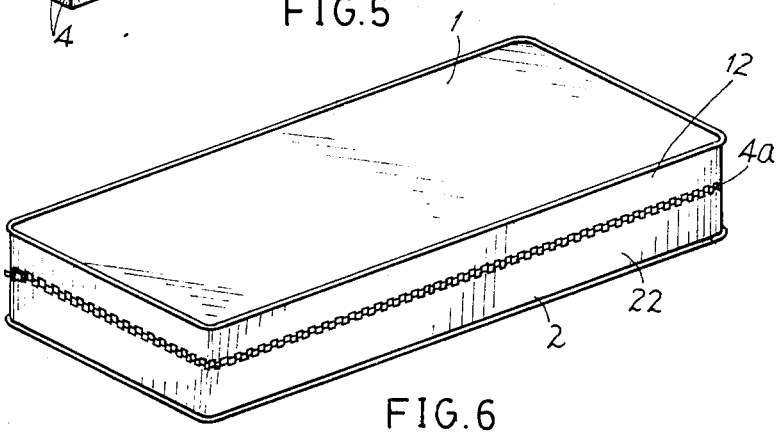
FIG. 6 shows still another preferred embodiment of the present invention.

As shown in FIG. 6, the perforations 14, 24 are omitted and the fastening means 4 is substituted with a zipper fastener 4a which will secure the side edges 12 of the upper sheet 1 and the side edges 22 of the lower sheet 2 to form the mattress 10. The outer jacket 5 may also be omitted in some application situations to save cost.

Figure 7:
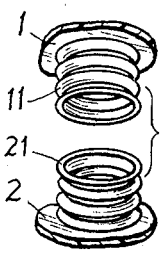
FIG. 7 shows a sleeve formed as bellows structure of the present invention.

The sleeves 11, 21 can be made as a bellows as shown in FIG. 7.

The present invention has the following advantages superior to a conventional bed mattress:

1. If only some springs are damaged, the mattress 10 can be broken down for replacing the damaged springs with new springs without discarding a complete mattress set so as to save money.
2. For handling or moving a mattress through a narrow door or window, the mattress can be dismantled and collapsed for easily carrying and removing of the parts, which can even be carried or assembled by a single man.
3. The springs 3 are easily jacketed into the sleeves 11, 21 without further fixation processing to save production cost and reduce maintenance problems. The upper sheet 1 and lower sheet 2 with the sleeves 11, 21 of the mattress 10 may be made by integrated molding of elastic plastic or rubber materials.
4. The upper sheet, the springs and the lower sheet of the mattress can be quickly assembled even by a single person in ten to twenty minutes without requiring any professional skill.
5. Since the partially damaged mattress can be easily repaired by a user himself or herself for its continuous service, the mattress of the present invention can be used for very long life to reduce the garbage disposal problem to a minimum.

The present invention may also be modified to be utilized for a sofa, chair or the like by those skill in the art, in which the modifications can be made within the scope of the appended claims of this invention.

We claim:

1. An assembled mattress comprising: an upper sheet having a plurality of upper sleeves each upper sleeve made as a bellows protruding downwardly from said upper sheet, a lower sheet having a structure being same as a structure of the upper sheet having a plurality of lower sleeves each lower sleeve made as a bellows protruding upwardly from said lower sheet, each said lower sleeve being axially aligned with each said upper sleeve, a plurality of helical springs each said spring jacketed in between said upper sleeve and said lower sleeve, a fastening means combinably securing the upper sheet with the lower sheet to form said mattress, and an outer jacket including a base casing for storing said mattress therein, an upper cover secured to said base casing, an upper liner packing formed under said upper cover of said jacket retained between said upper sheet of said mattress and said upper cover of said jacket, and a lower liner packing formed on a bottom plate of said base casing and retained between the lower sheet of said mattress and said bottom plate of said base casing.

2. A mattress according to claim 1, wherein said fastening means is selected from: a thread, a wire, and a rope.

3. A mattress according to claim 1, wherein both said upper sheet and lower sheet are respectively formed with a plurality of perforations or eyelets circumferentially perforated in a side edge along a periphery of the sheet, whereby upon a passing of said fastening means through said perforations or eyelets respectively formed in said upper sheet and said lower sheet, both said sheets are combined to form an integral mattress.

4. A mattress according to claim 1, wherein said fastening means is a zipper fastener having two fastener strips respectively formed on both side edges of the two sheets so that said zipper fastener combinably fastens the two sheets to form an integral mattress.

5. An assembled mattress comprising:

a first mattress unit, a second mattress unit and an outer jacket for storing said first and second mattress units therein;

each said mattress unit including: an upper sheet having a first vertical side edge formed on an outer periphery of said upper sheet, a first horizontal side edge formed on an inner periphery of said upper sheet adjacent to said outer periphery; a lower sheet having a structure being the same as a structure of said upper sheet having a second vertical side edge projectively positioned under said first vertical side edge of said upper sheet formed on an outer periphery of said lower sheet and a second horizontal side edge projectively positioned under said first horizontal side edge of said upper sheet formed on an inner periphery of said lower sheet, said lower sheet combinable with said upper sheet by a first fastening means and both said sheets being resiliently retained by a plurality of helical springs jacketed in a plurality of bellows formed in the two sheets;

said first mattress unit being fastened to said second mattress unit by securing two said first horizontal side edges of two said upper sheets and securing two said second horizontal side edges of two said lower sheets by two second fastening means.

* * * * *